US007498535B2

(12) United States Patent
Blake et al.

(10) Patent No.: US 7,498,535 B2
(45) Date of Patent: Mar. 3, 2009

(54) CIRCUIT BREAKER OPERATOR

(75) Inventors: Randy W. Blake, Marion, IA (US); Alexander S. Filippenko, Cary, NC (US); Duane L. Turner, Fairfax, IA (US)

(73) Assignee: Square D Company, Palatine, IL (US)

( * ) Notice: Subject to any disclaimer, the term of this patent is extended or adjusted under 35 U.S.C. 154(b) by 38 days.

(21) Appl. No.: 11/589,385

(22) Filed: Oct. 30, 2006

(65) Prior Publication Data

US 2008/0099318 A1 May 1, 2008

(51) Int. Cl.
*H01H 9/26* (2006.01)

(52) U.S. Cl. ..... 200/331; 200/330

(58) Field of Classification Search ..... 200/17 R, 200/52 R, 330, 331, 531–572, 252, 38 R
See application file for complete search history.

(56) References Cited

U.S. PATENT DOCUMENTS 4,540,859 A * 9/1985 Lemmer ..... 200/6 B
4,550,232 A * 10/1985 Lemmer ..... 200/16 A
4,764,745 A * 8/1988 Aoi et al. ..... 337/22
4,990,873 A 2/1991 Grunert et al.
5,323,131 A 6/1994 Castonguay
5,467,622 A * 11/1995 Becker et al. ..... 70/203
5,875,886 A * 3/1999 Elster ..... 200/331
5,934,452 A * 8/1999 Sanguedolce ..... 200/331
6,326,870 B1 12/2001 Larranaga et al.
2002/0100674 A1 8/2002 Rosen et al.

* cited by examiner

*Primary Examiner*—Michael A Friedhofer
*Assistant Examiner*—Lisa N Klaus

(57) ABSTRACT

Apparatus for providing an accelerated linear motion to a circuit breaker operating handle during ON or OFF operation of the circuit breaker. The accelerated linear motion being applied to the operating handle at a particular point during its movement such that the moveable contacts of the circuit breaker are not delayed in their opening or closing due to slow movement of the circuit breaker operating handle.

17 Claims, 10 Drawing Sheets

CIRCUIT BREAKER OPERATOR

CROSS-REFERENCE TO RELATED PATENTS

Not applicable

STATEMENT REGARDING FEDERALLY SPONSORED RESEARCH OR DEVELOPMENT

Not applicable

FIELD OF THE INVENTION

The present invention relates to circuit breakers, and particularly to molded case circuit breakers operators.

BACKGROUND OF THE INVENTION

Circuit breakers are typically found in load centers, service entrance boxes or auxiliary circuit panels and are generally intended for manual operation by human hands. Therefore, the internal mechanical operating components of the circuit breaker are designed to function properly in response to the speed at which force is applied to the circuit breaker operating handle by the human hand. However, in some applications remote or automatic operation of the circuit breaker may be required. In these situations an external source of force such as a motor, solenoid, pneumatic cylinder, flexible cable or other device capable of applying force to the circuit breaker handle can be used. An interconnecting mechanism transfers the force from the source to the circuit breaker operating handle. These interconnecting mechanism generally employ a fork-like operator that rigidly engages the sides of the circuit breaker operating handle during the ON-OFF operations. Typically the external source will be operate at a slower speed than normal human interface with the operating handle to prevent damage to the operating handle, the connecting mechanism and/or the external source or because of power limitations. If the speed at which the operating handle is moved between the ON and OFF positions is too slow, arcing can be initiated between the fixed and movable contacts of the circuit breaker as they begin to close or open. Arcing of the contacts can severely reduce the service life of the circuit breaker and in extreme cases can cause failure of the circuit breaker. Therefore, a mechanism that provides additional speed to the circuit breaker operating handle at an appropriate time during operation would be desirable to prevent contact arcing and to maintain or prolong the normal service life of the circuit breaker.

BRIEF DESCRIPTION OF THE DRAWINGS

The features of the invention will be more clearly understood from the following detailed description of the invention read together with the drawings in which.

Figure 1:
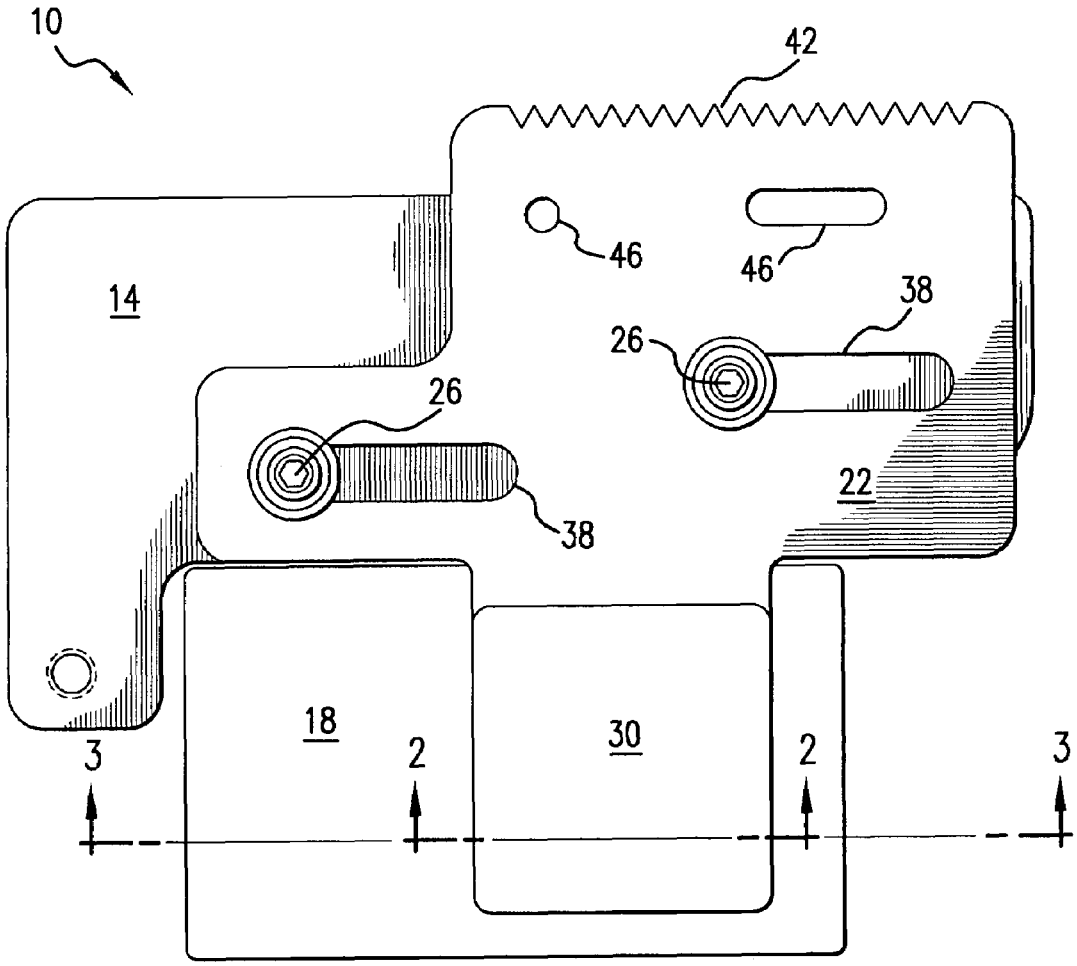
FIG. 1 illustrates in general one embodiment of a circuit breaker operating mechanism constructed in accordance with the present invention.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE PREFERRED EMBODIMENTS

Figure 2:
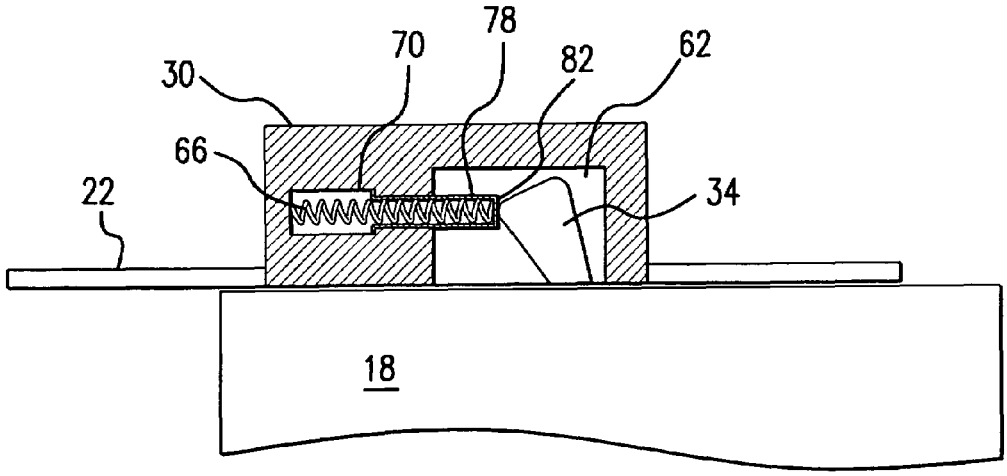
FIG. 2 is a cross section taken along line 2-2 of FIG. 1 and illustrates in more detail the operator of FIG. 1.
Figure 3A:
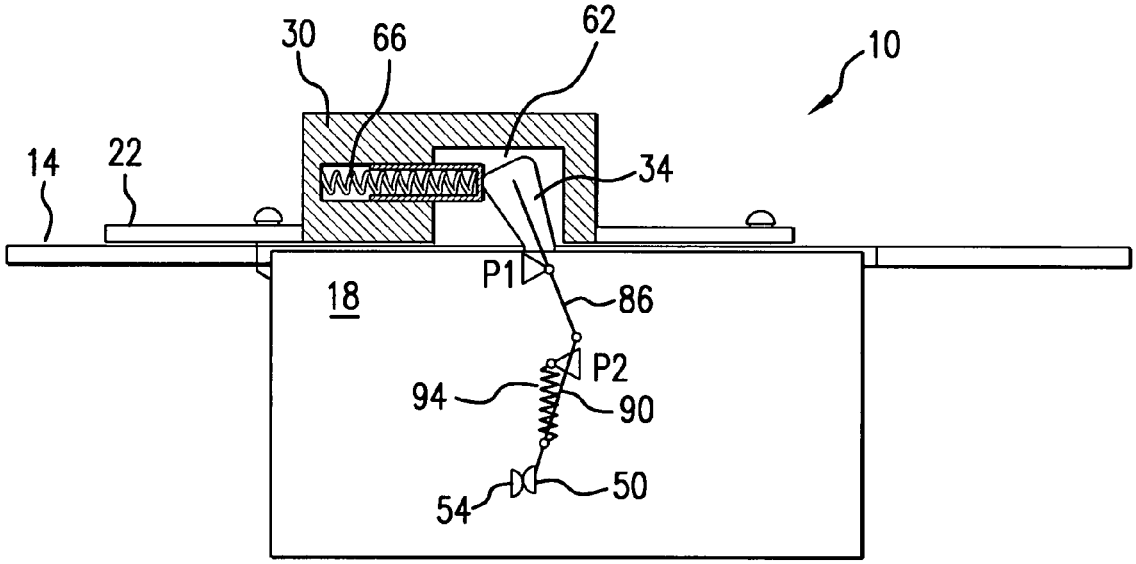
FIGS. 3A-3F are cross sections taken along line 3-3 of FIG. 1 and illustrate the relationships of a circuit breaker handle, internal contact operating spring and electrical contacts during an operation from the circuit breaker ON position (contacts closed) to the circuit breaker OFF position (contacts open) position using the embodiment of the circuit breaker operator shown in FIGS. 1 and 2.

FIG. 1 illustrates one embodiment of an apparatus for operating a circuit breaker manufactured in accordance with the present invention and generally indicated by reference numeral 10. In this embodiment, the apparatus 10 includes a frame 14, fixed with respect to a circuit breaker 18 being operated by the apparatus 10. The apparatus 10 further includes a slider 22, movably attached to the frame 14 by mounting hardware 26 such as screws, rivets, pins and C-clips or similar devices. The slider 22 includes an operator 30 configured (as shown in FIG. 2) for receiving an operating handle 34 of the circuit breaker 18. The operator 30 can be integrally formed from the slider or a separate module 134, as shown in FIGS. 7-10, attached to the slider 22. The mounting hardware 26 passes through slots 38 in the slider 22 such that the slider 22 is linearly movable between a first position corresponding to one of the circuit breaker's ON or OFF positions and a second position corresponding to the other of the circuit breaker's ON or OFF positions. The mounting hardware 26 can also provide the means by which the frame 14 is fixed with respect to the circuit breaker 18. The slider 22 moves between it's first and second positions in response to a force provided by an external source such as a motor, solenoid, pneumatic, cylinder, flexible cable or other device capable of applying a force sufficient to operate the circuit breaker 18. Force from the external source can be exerted on the slider 22 through a geared rack 42 or a bolted connection or drive pin received in apertures or slots 46 defined in the slider. It is to be understood that the apertures or slots 46 can have various shapes as required by the characteristics of the external source. The external source may apply force to the slider 22 at a slower more uniform speed than the speed at which a human would apply force to the circuit breaker handle 34 during manual operation of the circuit breaker 18. The slower uniform speed may be a characteristic of the external source providing force to the slider or may be required to protect the circuit breaker operating handle 34, the external source and/or the connecting mechanism from damage. Operating the circuit breaker handle 34 at a slower uniform speed can cause arcing between the circuit breaker movable contacts 50 and fixed contacts 54 (FIG. 3A). It is well know that arcing between electrical contact 50 and 54 will shorten the service life of circuit breaker 18 or result in a catastrophic failure of circuit breaker 18. To prevent arcing between the circuit breaker contacts 50 and 54, that could be caused by slow operation of the operating handle 34, the operator 30 is configured to apply force to the operating handle 34 at an accelerated speed with respect to the slower uniform speed at which the external source applies force to the slider 22.

FIG. 2 is a cross-sectional view of the operator 30 taken across line 2-2 of FIG. 1 illustrating in more detail those elements of the operator 30 that compensate for the slower uniform operating speed applied to the slider 22 by the external source. The operator 30 defines a cavity 62 for receiving the circuit breaker operating handle 34 and includes a first accelerator 66 for providing an accelerating force to the circuit breaker operating handle 34 at a particular point of its travel between the ON and OFF positions of circuit breaker 14. The first accelerator 66, a compressible spring having predetermined force characteristics, is captivated in a T-shaped aperture 70 defined in a wall 74 of the cavity 62 by a retainer 78. The retainer 78 is slidably supported by and retained in the T-shaped aperture 70 such that its distal end 82 extends into the cavity 62 and can engage the circuit breaker operating handle 34. When the slider 22 is not being moved between the circuit breaker ON position and the circuit breaker OFF position the retainer 78 is maintained in a pre-charged position by integrally formed stops 80 that engage the top of the T-shaped aperture 70 and by the accelerator 66 pushing against the retainer's distal end 82 (see FIG. 10 for a more detailed view of the first accelerator 66). In the pre-charged position the retainer 78 extends into the cavity 62 to its maximum length. As the slider 22 begins to move from the circuit breaker ON position toward the circuit breaker OFF position, the distal end 82 of the retainer 78 engages the operating handle 34. The force required to move the operating handle 34 toward the circuit breaker OFF position is greater than the predetermine force characteristic of the accelerator 66 causing the accelerator 66 to be compressed and slidably moving the retainer 78 into the aperture 70. As the slider 22 continues to move toward the circuit breaker OFF position the accelerator 66 will be further compress until the operating handle 34 engages the wall 74. At this point the predetermined force characteristic of the accelerator 66 has been reached and the retainer 78 is in a fully charged position. The predetermined force characteristic of the accelerator 66 is selected to be about 80% of the peak force required to move the operating handle 34 from the circuit breaker ON position to the circuit breaker OFF position. As the slider 22 is moved further toward the circuit breaker OFF position, the wall 74, now engaged with the operating handle 34, begins to move the operating handle 34 towards the circuit breaker OFF position. This operation will be discussed in more detail with respect to FIGS. 3A-3F and FIG. 4.

FIGS. 3A-3F are cross-sectional views taken through line 3-3 of FIG. 1, showing the inside of the operator 30 and, in a simplistic functional representation, the relationship of the operating handle 34 with respect to the movable contact 50 during the process of moving the operating handle 34, by means of the apparatus 10 of FIG. 1, from the circuit breaker ON position (FIG. 3A) to the circuit break OFF position (FIG. 3). Typically the circuit breaker operating handle 34 is pivotably supported by a portion of the circuit breaker housing at some point P1 and includes an internal operating end 86. The operating end 86 is movably connected to a first end of a movable contact lever 90 such that pivotal movement of the operating handle 34 about point P1 causes like movement of the movable contact lever 90 and the movable contact 50, which is attached to a second end of the movable contact lever 90. Movable contact 50 is biased into either the circuit breaker ON position (contacts closed) or circuit breaker OFF position (contacts open) by a contact operating spring 94. One end of the contact operating spring 94 is pivotably supported by a portion of the circuit breaker housing at some point P2 and the other end is connected to a particular point on the movable contact lever 90. In this arrangement, the contact operating spring 94 operates in an over center or toggle manner biasing the movable contact 50 into one of the circuit breaker ON or circuit breaker OFF positions by exerting a particular force on the movable contact lever 90 in each of the two positions. The particular force exerted on the movable contact lever 90 by the contact operating spring 94 in the circuit breaker ON position is generally greater than the particular force exerted on the movable contact lever 90 in the circuit breaker OFF position since a good electrical connection between the moveable contact 50 and fixed contact 54 must be maintained. To move between the circuit breaker ON and circuit breaker OFF positions the contact operating spring 94 must pass through an over center or toggle position where maximum spring extension is achieved. Immediately prior to reaching the over center position a peak force required to move the operating handle 34 from the circuit breaker ON to the circuit breaker OFF position will be attained. However, as the contact operating spring 94 approaches the over center point the force it exerts on the movable contact lever 90 to maintain the stable position approaches zero and the movable contact 50 can begin to move toward its other stable position. If the operating handle 34 is moved slowly through the toggle position 96 where the maximum extension of the contact operating spring 94 is achieved, and where the force applied to the movable contact 50 by the movable contact lever 90 is close to zero (area 98 in FIG. 4), arcing between the contacts 50 and 54 will be detrimental to the service life of the circuit breaker 18. The toggle position 96 may vary slightly among different circuit breakers 18 because of manufacturing tolerances. The approximate toggle position 96 with regard to manufacturing tolerances is shown as area 98 in FIG. 4. Moving through window 98 rapidly is most critical when moving from the circuit breaker ON position to the circuit breaker OFF position since arcing between the movable and fixed contacts, 50 and 54 respectively, will begin as soon as the movable contact 50 start to separate from the fixed contact 54. Arcing between the contact 50 and 54 will continue until there is sufficient space between the contacts 50 and 54 to extinguish the arc. Therefore, the speed at which the movable contact 50 separates from the fixed contact 54 is critical in extinguishing the arc before damage occurs.

FIG. 3A illustrates the position of the slider 22, operator 30 and accelerator 66 of the apparatus 10 with respect to the circuit breaker operating handle 34, movable contact 50, fixed contact 54 and internal contact operating spring 94 when the circuit breaker is in the ON (contacts closed) position. In this position, indicated as point A in the graph of FIG. 4, there is no force applied to the circuit breaker operating handle 34 by either the accelerator 66 or the wall 74.

Figure 3B:
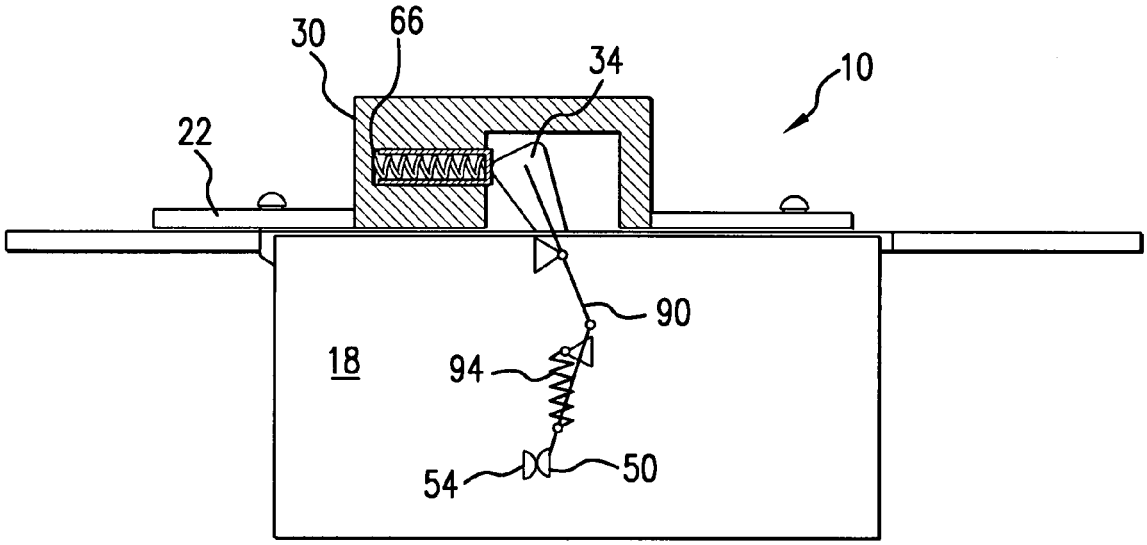

FIG. 3B illustrates the position of the slider 22, operator 30 and accelerator 66 of the apparatus 10 with respect to the circuit breaker operating handle 34, movable contact 50, fixed contact 54 and internal contact operating spring 94 at a point where the slider 22 has moved toward the circuit breaker OFF position sufficiently to fully charge the accelerator 66. At this point, indicated as point B in the graph of FIG. 4, the circuit breaker 18 remains in the ON (contacts closed) position and a force of approximately 80% of the peak operating force D is applied to the circuit breaker operating handle 34 by the accelerator 66.

Figure 3C:
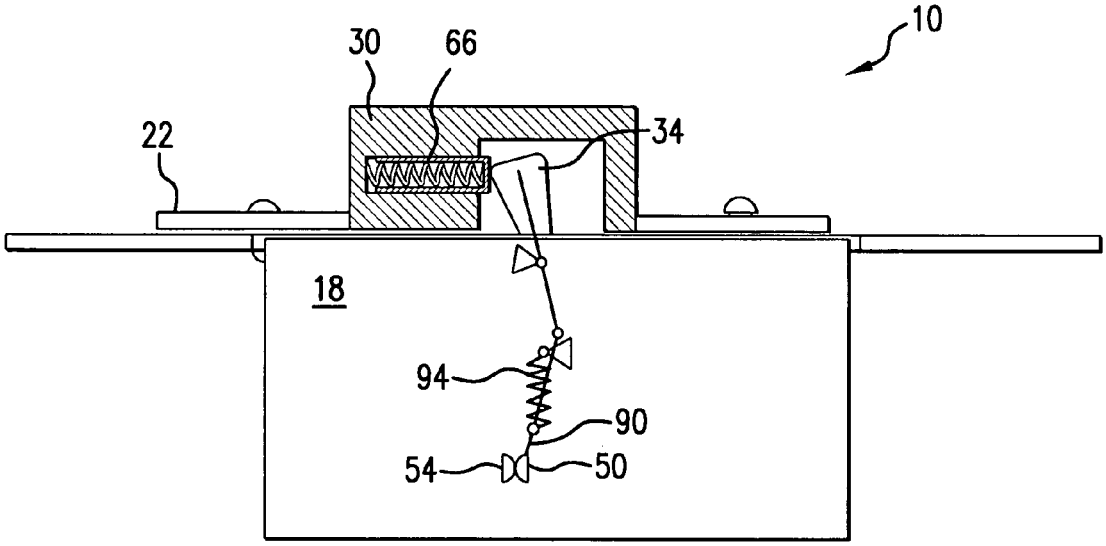

FIG. 3C illustrates the position of the slider 22, operator 30 and accelerator 66 of the apparatus 10 with respect to the circuit breaker operating handle 34, movable contact 50, fixed contact 54 and internal contact operating spring 94 at a point where the slider 22 has moved past the peak operating force PF to a point at which the charge of the accelerator 66 is slightly greater than the force applied to the slider 22 by the external source. In this position, indicated as point C in the graph of FIG. 4, the circuit breaker 18 remains in the ON (contacts closed) position and the force applied to the operating handle 34 is supplied by the accelerator 66, which is greater than the resistance force produced by the operating handle 34 depending on the position of the contact operating spring 94 and/or the friction of the internal mechanism of circuit breaker 18. The accelerator 66 has begun to accelerate the speed at which the operating handle 34 moves toward the circuit breaker OFF position.

Figure 3D:
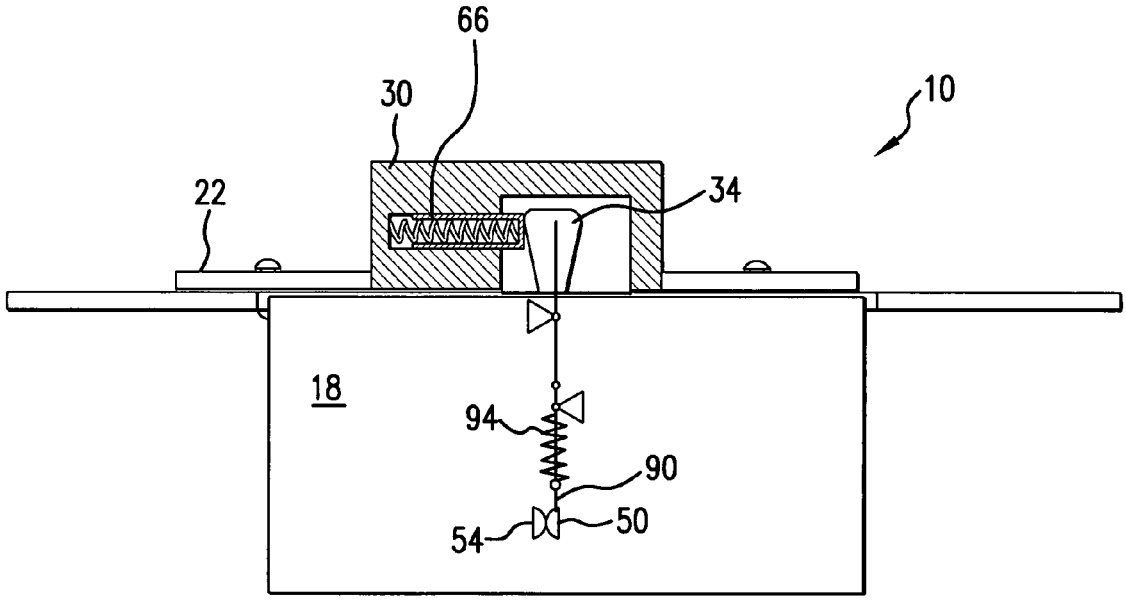

FIG. 3D illustrates the position of the slider 22, operator 30 and accelerator 66 of the apparatus 10 with respect to the circuit breaker operating handle 34, movable contact 50, fixed contact 54 and internal contact operating spring 94 at a point where the slider 22 has moved toward the circuit breaker OFF position to a point at which the force applied to the movable contact 50 by the contact operating spring 94 is approximately zero. In this position, indicated as area 98 in the graph of FIG. 4, the circuit breaker 18 remains in the ON (contacts closed) position but the movable contact 50 is starting to move away from the fixed contact 54. The force applied to the operating handle 34 is supplied by the accelerator 66, which is greater than the resistance force or operating handle 34. The accelerator 66 has begun to accelerate the speed at which the operating handle 34 moves toward the circuit breaker OFF position and the movable contact 50 is passing through window 98.

Figure 3E:
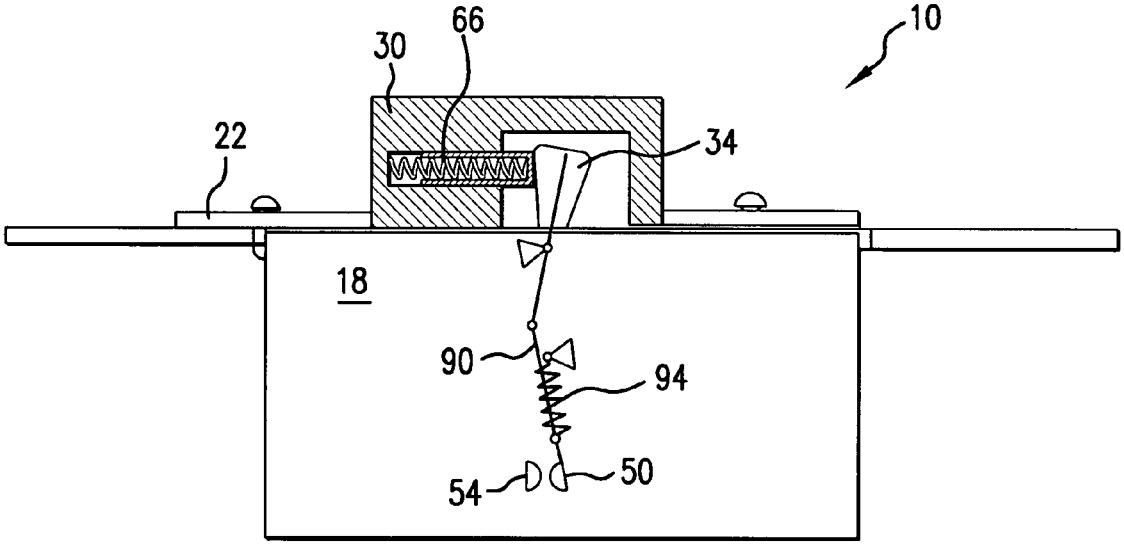

FIG. 3E illustrates the position of the slider 22, operator 30 and accelerator 66 of the apparatus 10 with respect to the circuit breaker operating handle 34, movable contact 50, fixed contact 54 and internal contact operating spring 58 at a point where the movable contact 50 has separated from the fixed contact 54 and the operating handle 34 is accelerating towards the circuit breaker OFF position by force applied by the accelerator 66 at a speed greater than that of the slider 22. In this position, indicated as point E in the graph of FIG. 4, the circuit breaker 18 is in the OFF (contacts open) position and the movable contact 50 is moving rapidly toward the full OFF position. In this position, indicated as point F in the graph of FIG. 4, a force applied to the operating handle 34 is supplied by the accelerator 66 and the speed of the operating handle's 34 movement toward the circuit breaker OFF position is increasing.

Figure 3F:
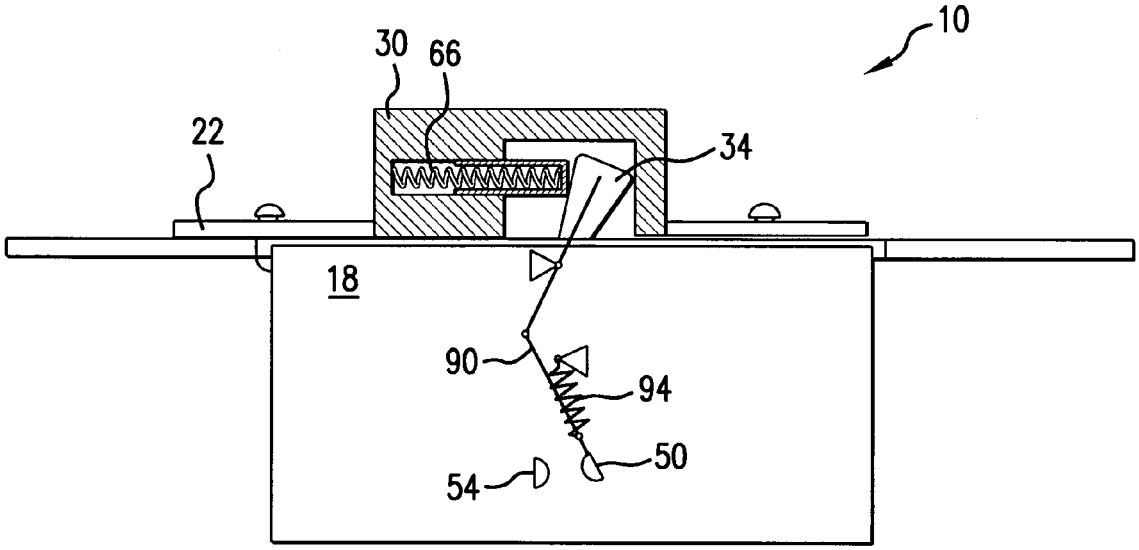

FIG. 3F illustrates the position of the slider 22, operator 30 and accelerator 66 of the apparatus 10 with respect to the circuit breaker operating handle 34, movable contact 50, fixed contact 54 and internal contact operating spring 94 when the circuit breaker 18 is in the OFF (contacts open) position. In this position, indicated as point F in the graph of FIG. 4, there is no force applied to the circuit breaker operating handle 34 by either the accelerator 66 or the wall 74.

Figure 4:
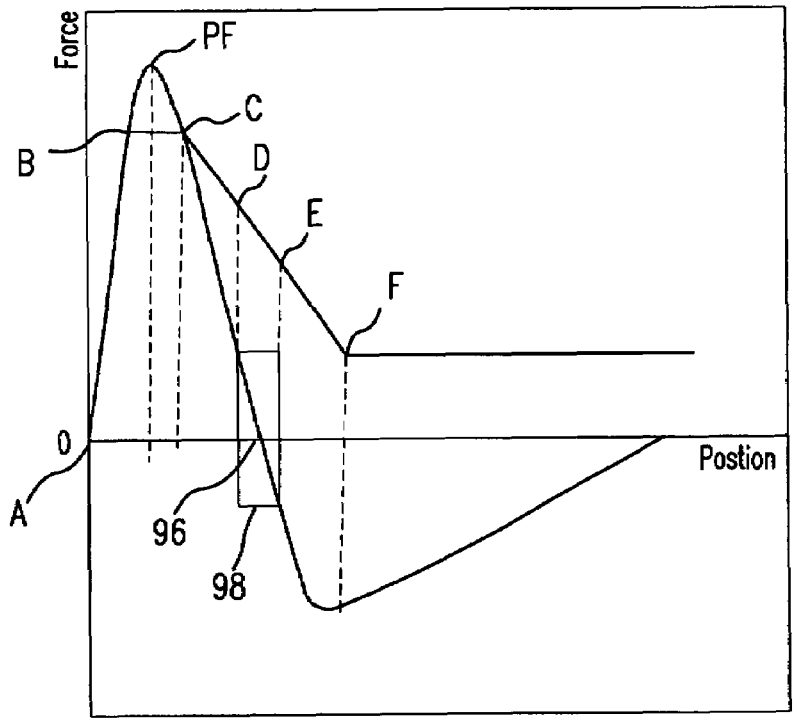
FIG. 4 illustrates in graphic form the relationship of the position of the circuit breaker handle and circuit breaker electrical contacts with respect to the force applied to circuit breaker operating handle during the operation of FIGS. 3A-3F.

FIG. 4 is a graph illustrating the force applied to the operating handle 34 with respect to the position of the operating handle 34 when being operated by a slower uniform external source with and without the apparatus of the present invention. FIG. 4 also illustrates that the spring constant of the accelerator 66 must be selected such that between point C and F of the graph the force of the accelerator 66 is greater than the resistance force of the operating handle 34.

Figure 5:
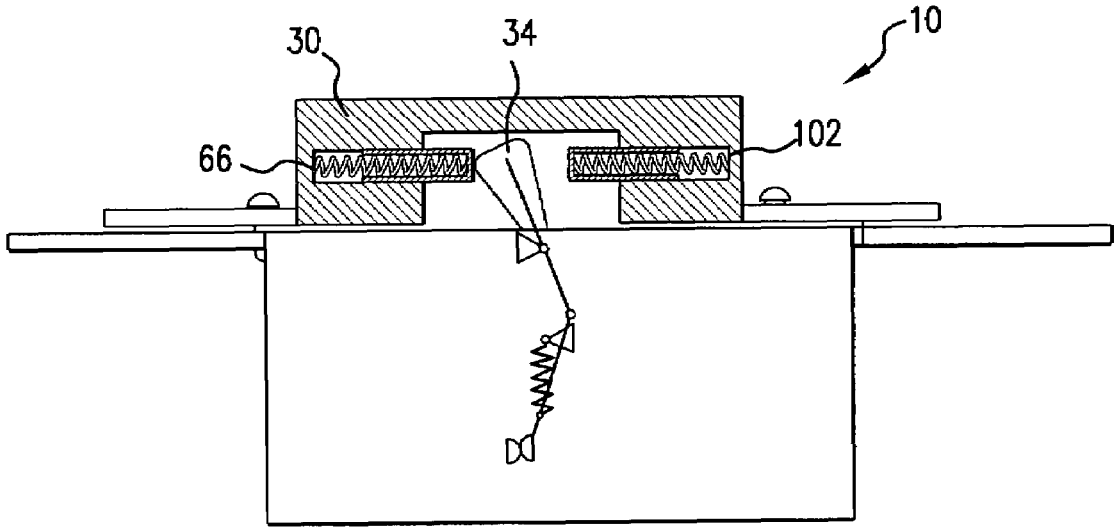
FIG. 5 illustrates a second embodiment of the present invention wherein two accelerators are employed.

FIG. 5 illustrates a second embodiment of the invention wherein a second accelerator 102 is supported by the operator 30. The second accelerator 102 operates in the same manner as the first accelerator 66 but provides acceleration to the operating handle 34 in its movement from the circuit breaker OFF position to the circuit breaker ON position. The force value at which the second accelerator 102 is fully charged is not the same as the fully charged force value of the first accelerator 66.

Figure 6:
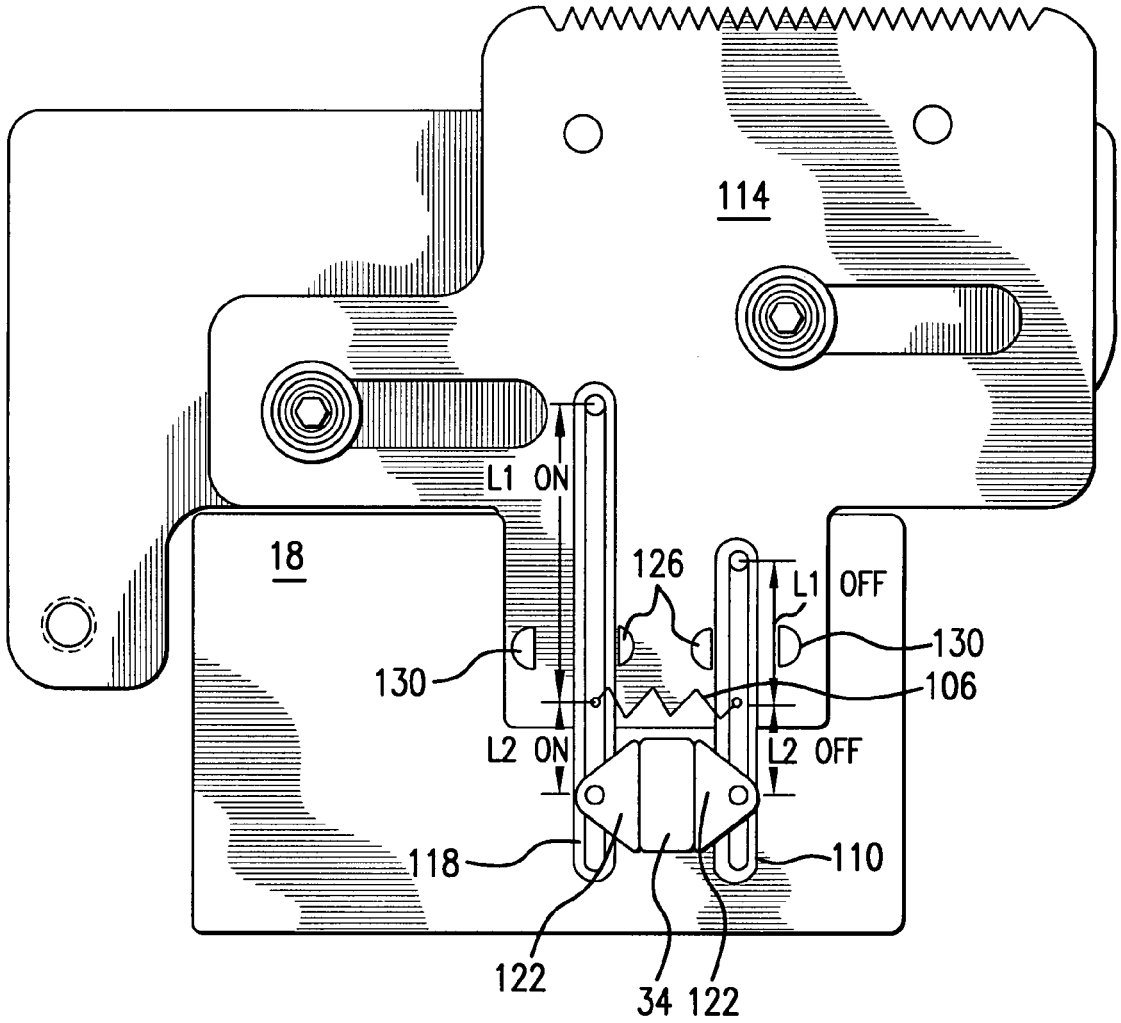
FIG. 6 illustrates a third embodiment of the present invention wherein one accelerator provides acceleration for both ON and OFF operations of the circuit breaker operating handle.

FIG. 6 illustrates a third embodiment of the invention wherein an analogous operator structure comprises a single spring and two levers. A single accelerator 106 provides accelerating force for both the OFF and ON operations of the operating handle 34 at two different force values. An OFF lever 110 is pivotably attached to the slider 114 for engagement with the operating handle 34 during the circuit breaker OFF operation, wherein the fixed and movable contacts, 54 and 50 respectively, are separated as shown in FIGS. 3D-3F, and an ON lever 118 is pivotably attached to the slide 114 for engaging the operating handle 34 during the circuit breaker ON operation, wherein the fixed and movable contacts, 54 and 50 respectively, are together as shown in FIGS. 3A and 5. The OFF and ON levers 110 and 118 are arranged generally parallel with one another and have operating handle engaging features 122 extending below the slider 114. A neutral lever stop 126 is provided for each of the OFF and ON levers 110 and 118 to prevent them from acting upon the operating handle 34 when the opposite function (ON or OFF) is being completed (ie. the ON lever neutral stop 126 prevents the ON lever 118 from engaging the operating handle 34 during an OFF operation of the circuit breaker). An operating stop 130 is also provided for each of the OFF and ON levers 110 or 118 such that when the OFF or ON operating lever 110 or 118 is fully charged it will engage its associated operating stop 130 for movement with the slider 114. The single accelerator 106 is connected between the OFF and ON levers 110 and 118 such that each lever 110 or 118 has an arm length L1 and an arm length L2 defined by the point at which the accelerator 106 is attached. The lengths L1 and L2 are selected to provide the appropriate accelerating force for the operating handle 34. The force on the handle is determined by the formula $$F_{HANDLE}=F_{SPRING}\times L_P/L_{ARM}.$$

Where $F_{SPRING}$ is the spring force, $L_{ARM}$ is the length of the arm and $L_P$ is the distance between the pivot point and the spring mounting point.

Figure 8:
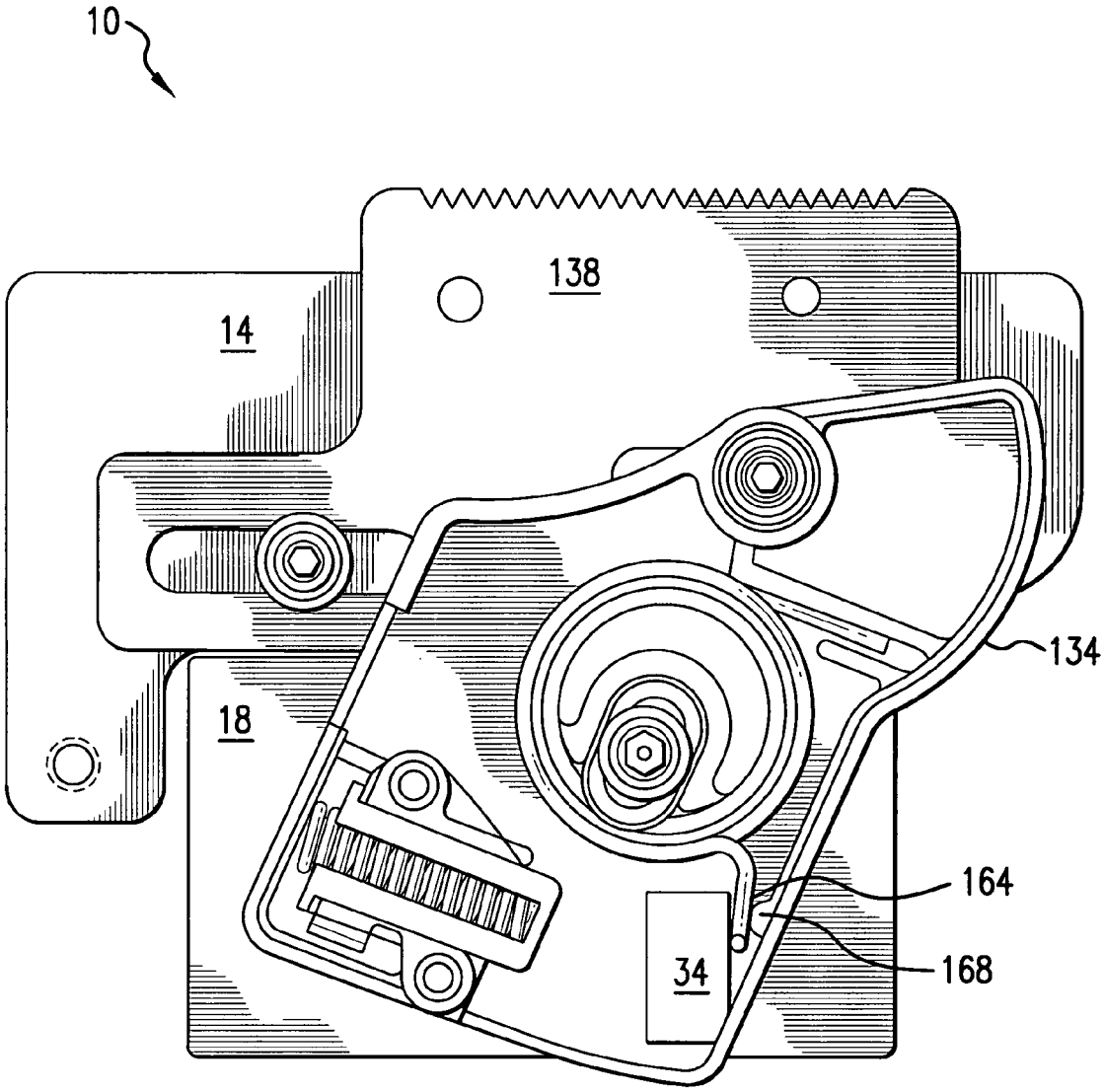
Figure 9:
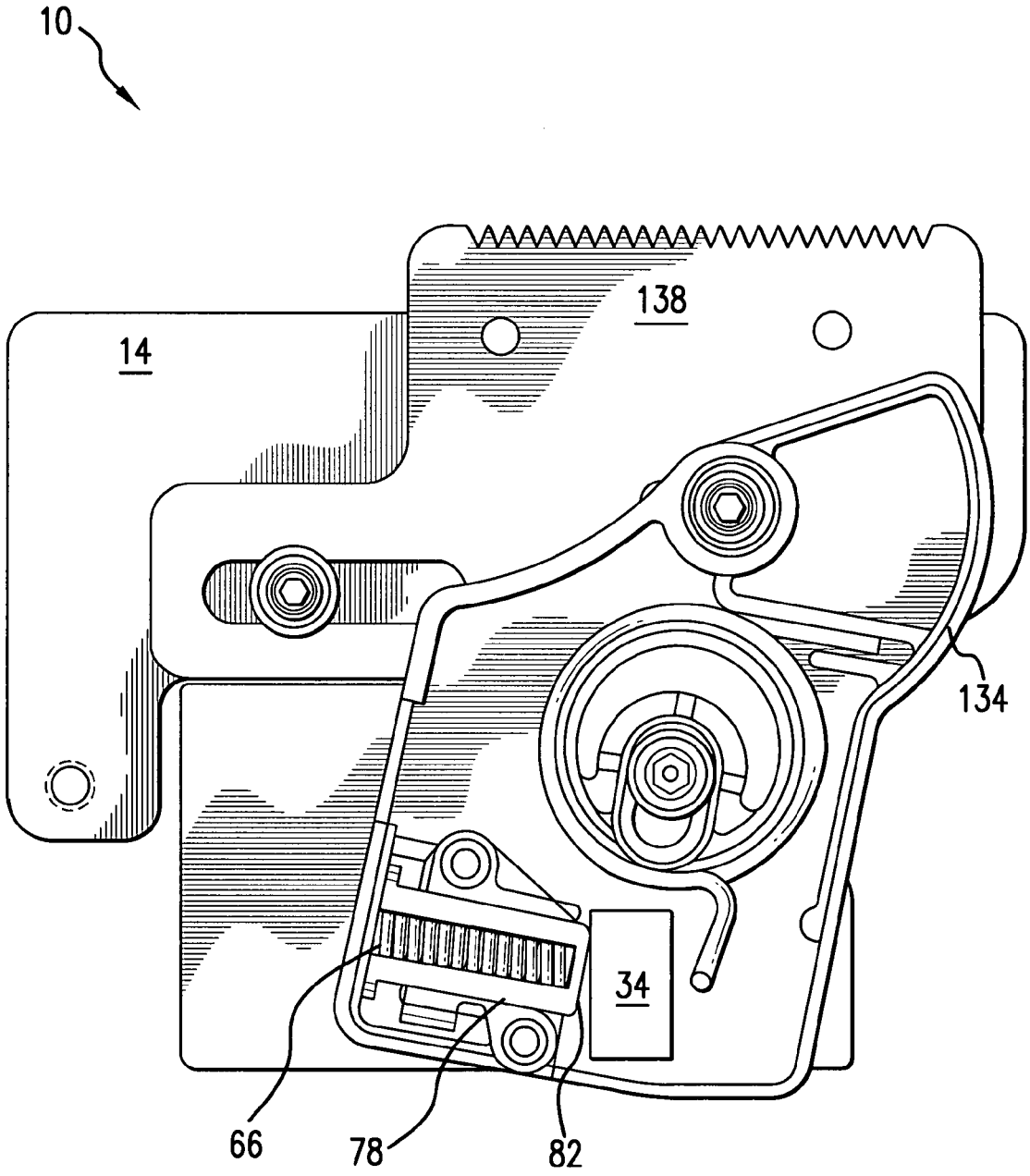
Figure 10:
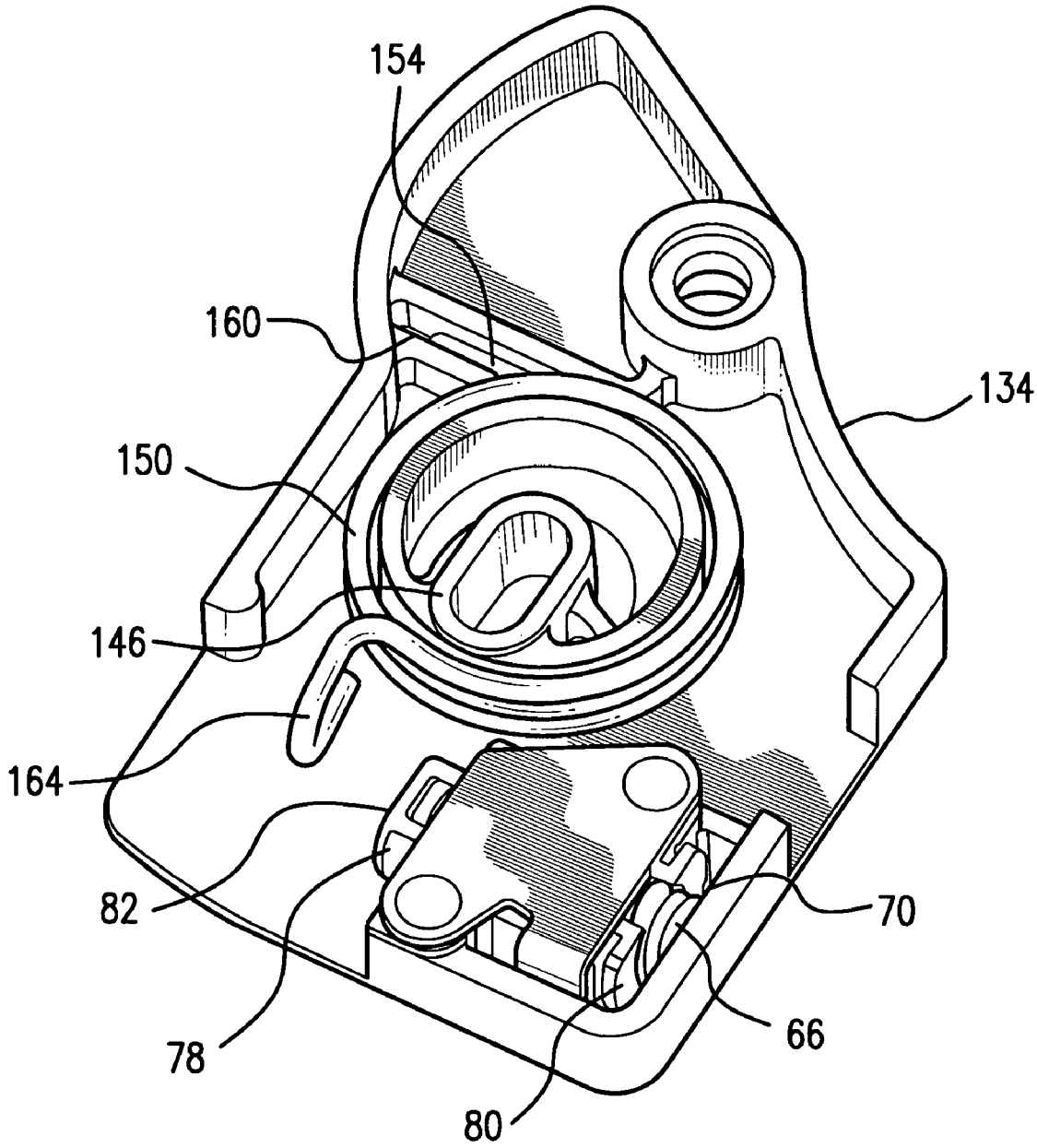
FIG. 10 illustrate in more detail the operator module of FIGS. 7-9.

FIGS. 7-10 illustrate a fourth embodiment of the invention wherein an operator module 134 is connected to the frame 14 and slider 138 for pivotal movement between the circuit breaker ON position and the circuit breaker OFF position. The slider 138 provides the force for movement of the operator module 134 in response to force provided by an external source as defined with respect to the first embodiment of the apparatus 10. The operator module 134 is connected to the frame 14 and slider 138 by slider mounting hardware 26 and pivoted between the circuit breaker ON and circuit breaker OFF positions by a pin or bolt 142 attached to the slider 138 and passing through a slot 146 defined in the operator module 134. Referring now to FIG. 10, the operator module 134 defines a T-shaped aperture 70 for slidably supporting a first accelerator 66 and retainer 78 of the type employed in the first and second embodiments of the apparatus 10. The retainer 78 includes stops 80 which engage the top of the T-shaped aperture 70 when the retainer 78 is in the precharged position. The first accelerator 66 provides an accelerating force on the operating handle 34 during the circuit breaker OFF to circuit breaker ON operation, wherein the fixed and movable contacts, 54 and 50 respectively are together as shown in FIGS. 3A and 5. A second accelerator 150 is also supported by the operator module 134 for providing force on the operating handle 34 during the circuit breaker ON to circuit breaker OFF operation, wherein the fixed and movable contacts, 54 and 50 respectively are separated as shown in FIGS. 3D-3F. Second accelerator 150 is a coil spring supported about the slot 146 and having a first end 154 captivated in slot 160 defined in the operator module 134 and a free end 164 for engaging the operating handle 34.

Figure 7:
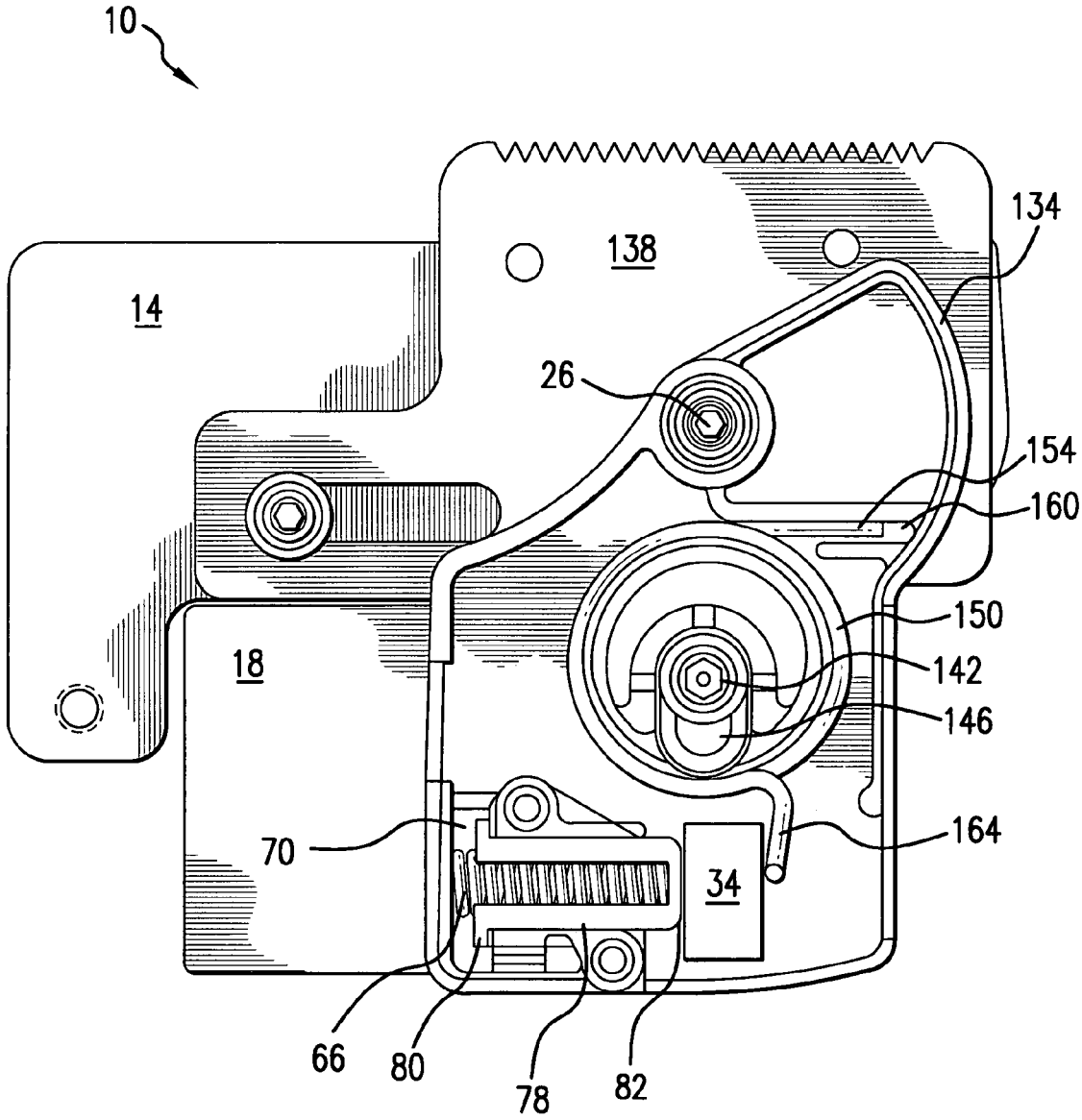
FIGS. 7-9 illustrate a fourth embodiment of the present invention during the ON to OFF operation of the circuit breaker.

FIG. 7 illustrate the apparatus 10 in the circuit breaker ON position. In this position both the first and second accelerators, 66 and 150 respectively, are in their precharged position and neither are applying force to the operating handle 34.

FIG. 8 illustrate the apparatus 10 during the operation of turning the circuit breaker 18 OFF. In this operation the second accelerator 150 is in its fully charged position and is applying force to the operating handle 34 through free end 164 which is abuted to bumper 168 formed from the operating module 134.

FIG. 9 illustrate the apparatus 10 during the operation of turning the circuit breaker 18 ON. In this operation the first accelerator 78 is in its fully charged position and is applying force to the operating handle 34 through the distal end 82 of retainer 78.

We claim:

1. An apparatus for operating a circuit breaker comprising:

a frame fixed with respect to the circuit breaker;

a slider movably attached to the frame such that the slider is linearly movable between a first position and a second position, wherein at the first position a movable contact and a fixed contact are closed and in the second position the movable contact and the fixed contact are open;

means for moving the slider between the first and second positions;

an operator attached to the slider and configured for receiving a circuit breaker operating handle, the operator transmitting linear motion to the circuit breaker operating handle at an accelerated speed with respect to the motion received from the means for moving the slider such that the opening of the circuit breaker contact is accomplished within an optimal time period to prevent arcing.

2. The apparatus of claim 1, wherein the accelerated linear motion is applied to the circuit breaker operating handle at a particular point of its movement from the ON to OFF operation.

3. The apparatus of claim 2, wherein the particular point of circuit breaker handle movement at which the accelerated linear motion is applied is when the force required to maintain the first position is approximately zero.

4. The apparatus of claim 1, wherein the means for moving the slider is a motor.

5. The apparatus of claim 1, wherein the means for moving the slider is a cable operator.

6. The apparatus of claim 1, wherein the operator includes an accelerator positioned to engage the circuit breaker operating handle.

7. The apparatus of claim 6, wherein the accelerator is retained by an accelerator retainer.

8. The apparatus of claim 6, wherein the accelerator is moved to a charged position by engagement of the circuit breaker operating handle with the accelerator slide.

9. The apparatus of claim 6, wherein the accelerator is a compression spring.

10. The apparatus of claim 9, wherein the compression spring is selected to have a charged force value not less than 80% of the maximum force required to move the circuit breaker operating handle from the ON position to the OFF position.

11. The apparatus of claim 6, wherein the operator includes a second accelerator supported by the operator for providing an accelerated linear motion to the circuit breaker operating handle at a particular point of its movement from the OFF to ON operation.

12. The apparatus of claim 11, wherein the second accelerator has a charged force value that is not equal to the charged force value of the first accelerator.

13. The apparatus of claim 11, wherein the second accelerator is a torsion spring.

14. An apparatus far operating a circuit breaker comprising:

a frame fixed with respect to the circuit breaker;

a slider movably attached to the frame such that the slider is linearly movable between a first position and a second position;

means for moving the slider between the first and second positions;

an operator attached to the slider and configured for receiving a circuit breaker operating handle, the operator transmitting linear motion to the circuit breaker operating handle at an accelerated speed with respect to the motion received from the means for moving the slider.

15. The apparatus of claim 14, wherein the accelerated linear motion is applied to the circuit breaker operating handle at a particular point of its movement between the ON and OFF positions such that the opening and closing of the circuit breaker contacts is accomplished within an optimal time period to prevent arcing.

16. The apparatus of claim 14, wherein the operator includes a first accelerator positioned to engage the circuit breaker operating handle during the ON to OFF operation and a second accelerator positioned to engage the circuit breaker operating handle during the OFF to ON operation.

17. The apparatus of claim 16, wherein the charged force value of the first and second accelerators is selected to be not less than 80% of the maximum force required to move the circuit breaker operating handle to the ON or OFF position to which the first or second accelerator assists the circuit breaker operating handle to be moved.

* * * * *